US007364262B2

(12) United States Patent
Quintana et al.

(10) Patent No.: US 7,364,262 B2
(45) Date of Patent: Apr. 29, 2008

(54) SYSTEM AND A METHOD FOR VARIABLE VELOCITY PRINTING

(75) Inventors: Jason M. Quintana, Brush Praire, WA (US); James Chen, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 275 days.

(21) Appl. No.: 10/899,989

(22) Filed: Jul. 26, 2004

(65) Prior Publication Data

US 2006/0017771 A1 Jan. 26, 2006

(51) Int. Cl.
*B41J 2/15* (2006.01)
*B41J 2/145* (2006.01)
*B41J 29/393* (2006.01)

(52) U.S. Cl. ..... 347/40; 347/19

(58) Field of Classification Search ..... 347/9, 347/12, 16, 37, 41, 19, 40
See application file for complete search history.

(56) References Cited

U.S. PATENT DOCUMENTS

| | | | | |
|---|---|---|---|---|
| 4,422,781 | A | 12/1983 | Armfield et al. | |
| 4,679,053 | A | 7/1987 | Katsurai et al. | |
| 4,801,978 | A | 1/1989 | Lama et al. | |
| 5,262,937 | A | 11/1993 | Mackin et al. | |
| 6,447,181 | B1 | 9/2002 | Hagstrom et al. | |
| 6,629,751 | B2 | 10/2003 | Giere et al. | |
| 6,695,426 | B2 * | 2/2004 | Herwald et al. | 347/19 |

* cited by examiner

*Primary Examiner*—Matthew Luu
*Assistant Examiner*—Lisa M Solomon

(57) ABSTRACT

A method for variable velocity printing includes printing a first swath at a first velocity, and printing a second swath at a second velocity. Thus, different swaths of a single print job can be printed at different swath velocities. By varying the swath velocity between swaths, mechanical vibrations that can degrade or negatively impact the quality of the resulting printed product can be ameliorated.

13 Claims, 6 Drawing Sheets

SYSTEM AND A METHOD FOR VARIABLE VELOCITY PRINTING

BACKGROUND

A typical inkjet printing mechanism uses cartridges, often called "pens," which eject drops of liquid colorant, referred to generally herein as "ink," onto a print receiving medium. Each pen has a printhead formed with one or more very small nozzles through which the ink drops are fired. To print on a print medium, nozzles of the inkjet printer eject tiny droplets of ink, or dots, during each horizontal pass of the printhead over the print medium to form a row of dots. Each horizontal pass of a printhead over a print medium is called a swath. After each preceding swath, the print medium is incrementally advanced. Through a succession of swaths, images or letters are printed on the print medium.

One form of inkjet printing utilizes fixed "drop weight" ink droplets deposited in a uniform grid. Ideally, each dot has a uniform diameter and each dot location is placed at a uniform distance in each row on the print medium and each preceding row of dots is placed the same distance from the succeeding row of dots. However, minor variations in dot location can produce print defects such as a series of repeated darker vertical bands (vertical striping) that is especially visible on uniform colored images. Vertical striping is caused by repeated patterning of small errors on the printed image. This effect is typically worsened when printing unidirectionally (a print mode in which the printheads deposit ink only while scanning in one direction across the page, and are quiescent on the return scan), as contrasted to bidirectional printing (a print mode where the printheads deposit ink in both scan directions).

Typically, the scanning carriage carrying the pens is scanned across the print media at a substantially constant rate or "swath velocity". Due to the uniform swath velocity traditionally used, print velocity remains the same for each printing swath. This can create a dynamic resonance within the printing system coinciding with the mechanical system/stiffness of the mechanism. As a result of the constant swath velocity and resonance, vibrations can be induced in the printer which are timed the same on each swath and cause a series of repeated vertical stripe print defects to show up on the printed image.

Constant efforts have been made to decrease print time and increase image quality of images printed with inkjet printing methods. Consequently, a number of costly methods, such as using a combination of different belt materials, have been introduced in an effort to minimize or otherwise hide the vertical striping effects mentioned above.

SUMMARY

A method for variable velocity printing includes printing a first swath at a first velocity, and printing a second swath at a second velocity.

BRIEF DESCRIPTION OF THE DRAWINGS

The accompanying drawings illustrate various embodiments of the present method and system and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

A method and an apparatus for eliminating defects such as banding or vertical striping of a printed image are described herein. More specifically, a method is described for upsetting the regularity of a printing order or varying the carriage velocity used to print a desired image in order to reduce the effect of cyclic defects, such as those caused by mechanical resonances, on a printed image. A number of exemplary structures and methods of the variable velocity printing method are described in detail below.

As used in this specification and in the appended claims, the term "ink" is meant to be understood broadly as any jettable fluid, with or without colorant that may be selectively ejected by any number of inkjet printing devices. Additionally, the term "jettable" is meant to be understood as a fluid that has a viscosity suitable for precise ejection from an inkjet printing device. Moreover, the term "dots per inch" or "dpi" is meant to be understood broadly as a measure of the resolution produced by a printing device. The term "retrace swath" is meant to be understood as a path traversed by a carriage when returning to a starting position in order to begin a new swath or print job when performing a unidirectional printing operation.

In the following description, for purposes of explanation, numerous specific details are set forth in order to provide a thorough understanding of the present system and method for variable swath velocity printing. It will be apparent, however, to one skilled in the art that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

Figure 1:
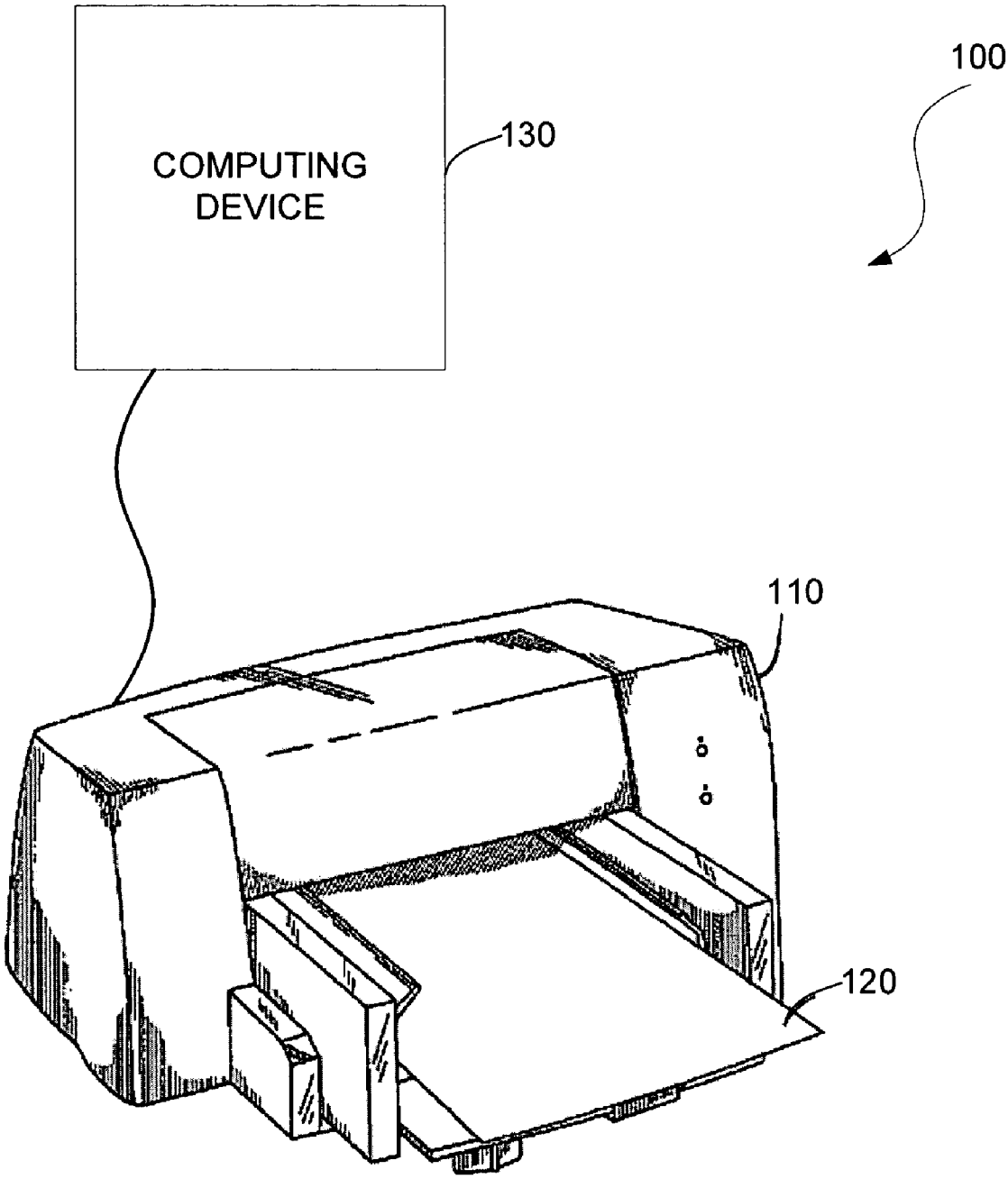
FIG. 1 is simple block diagram illustrating an inkjet printing system according to one exemplary embodiment.

FIG. 1 illustrates an inkjet printing system (100) configured to incorporate the present variable swath velocity printing method according to one exemplary embodiment. As show in FIG. 1, an inkjet printing system (100) may include an inkjet printer (110) and a print medium (120) disposed on the inkjet printer (110). The inkjet printer (110) of the inkjet printing system (100) illustrated in FIG. 1 may be any shape or size sufficient to house an inkjet material dispenser and any associated hardware necessary to perform the present variable velocity inkjet printing method. The inkjet printer (110) may contain one or more material dispensers, print medium positioning rollers or belts, servo mechanisms, and/or computing devices as will be further described in detail below with reference to FIG. 2.

The inkjet printing system (100) may generate and/or receive a print job from a communicatively coupled computing device (130) wherein the print job includes a digital description of a desired image. The digital description is then further computed into a series of motion and dispensing commands that are then used by the inkjet printer (110) to deposit liquid image forming material on the print medium (120) thereby forming a desired image. The method described herein may be applied by any inkjet material dispenser incorporated by the inkjet printer illustrated in FIG. 1 when dispensing ink to form a desired image. The inkjet material dispenser employed by the inkjet printer (100) to perform the present method may be any inkjet capable of performing print on demand applications including, but in no way limited to, thermally activated inkjet material dispensers, mechanically activated inkjet material dispensers, electrically activated inkjet material dispensers, magnetically activated material dispensers, and/or piezoelectrically activated material dispensers. Additionally, any number of print mediums (120) may be used by the present system and method including, but in no way limited to, paper, plastic, transparencies, or fabric.

Figure 2:
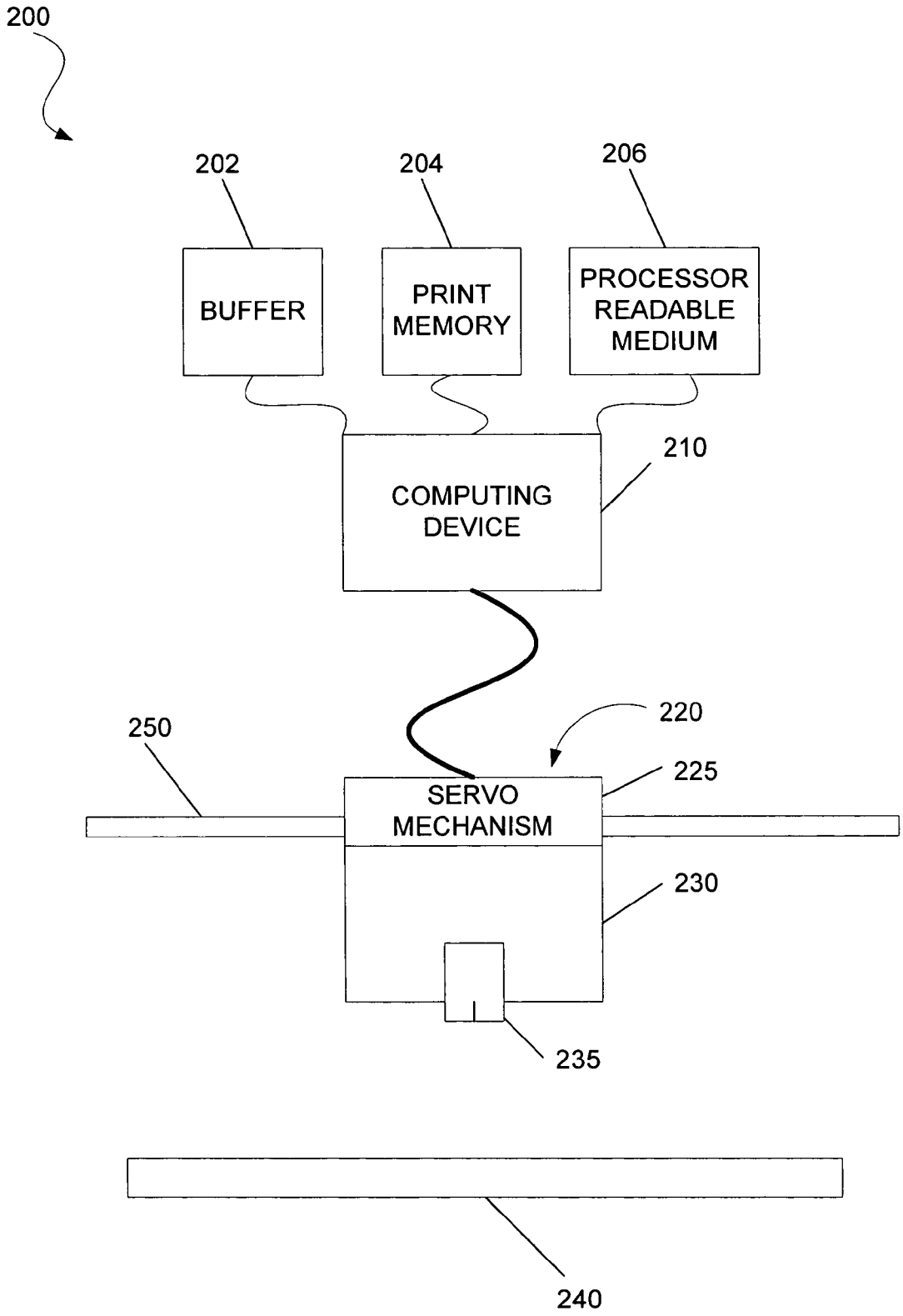
FIG. 2 is a simple block diagram illustrating the internal components of an inkjet printing system according to one exemplary embodiment.

FIG. 2 further illustrates the components of an inkjet printer according to one exemplary embodiment. As illustrated in FIG. 2, an inkjet printer (200) may include a computing device (210) communicatively coupled to a servo mechanism (225) that controls a pen (220). FIG. 2 also illustrates a number of data structures that may form a part of the computing device (210) or alternatively be communicatively coupled to the computing device. As illustrated in FIG. 2, a print buffer (202), a print memory (204) and a processor readable medium (206) may all form a part of or be communicatively coupled to the computing device to be accessed during a print operation as is further explained below. The print buffer (202), the print memory (204) and the processor readable medium may include, but are in no way limited to, random access memory (RAM), magnetic random access memory (MRAM), read only memory (ROM), and/or flash memory. The computing device (210) that accesses the above components may also communicate commands to the servo mechanism (225) causing it to selectively position the carriage assembly (230). The computing device (210) illustrated in FIG. 2 may be either a remote computer communicatively coupled to the inkjet printer (200) or alternatively the computing device (210) may be one that forms an integral part of the inkjet printer circuitry.

The servo mechanism (225) illustrated in FIG. 2 may be any number of motors, belts, and/or gears configured to selectively and accurately position the carriage assembly (230) upon receiving commands from the computing device (210). The servo mechanism (225) is configured to vary both velocity and position in response to commands received from the computing device (210). The pen (220) may also be slideably attached to a stabilizer bar (250) configured to stabilize and guide the pen (220), thereby aiding the motors, belts, and/or gears in their positioning of the pen (220). Additionally, the servo mechanism (225) of the present exemplary inkjet printer (200) may form a part of the pen (220) as illustrated in FIG. 2 or may be controllably coupled to the pen (220) assembly through a number of belts and/or gears.

The pen assembly (220) of the inkjet printer (200) illustrated in FIG. 2 may include a moveable carriage assembly (230) having one or more inkjet printheads (235) coupled thereto. The moveable carriage assembly (230) is controllably coupled to the servo mechanism (225) such that the servo mechanism may selectively position the moveable carriage assembly (230) in response to commands received from the computing device (210). The one or more printheads (235) coupled to the moveable carriage assembly (230) may include, but are in no way limited to, thermally activated inkjet material dispensers, mechanically activated inkjet material dispensers, electrically activated inkjet material dispensers, magnetically activated material dispensers, and/or piezoelectrically activated material dispensers.

Additionally, the pen assembly (220) may include one or more material reservoirs (not shown) configured to supply ink to the inkjet printheads (235). The material reservoirs (not shown) may be, according to various exemplary embodiments, on-axis or off-axis material reservoirs. Once positioned by the servo mechanism (225), the pen (220) may controllably eject a desired ink supplied by one of the material reservoirs. The ink that is selectively ejected by the pen (220) may be deposited onto a desired print medium (120; FIG. 1) that has been positioned adjacent to the print head (235) by a print medium transport (240). The print medium transport (240) may be any number of belts and/or rollers configured to selectively position a print medium (120; FIG. 1) adjacent to the print head (235).

Exemplary Implementation and Operation

Figure 3:
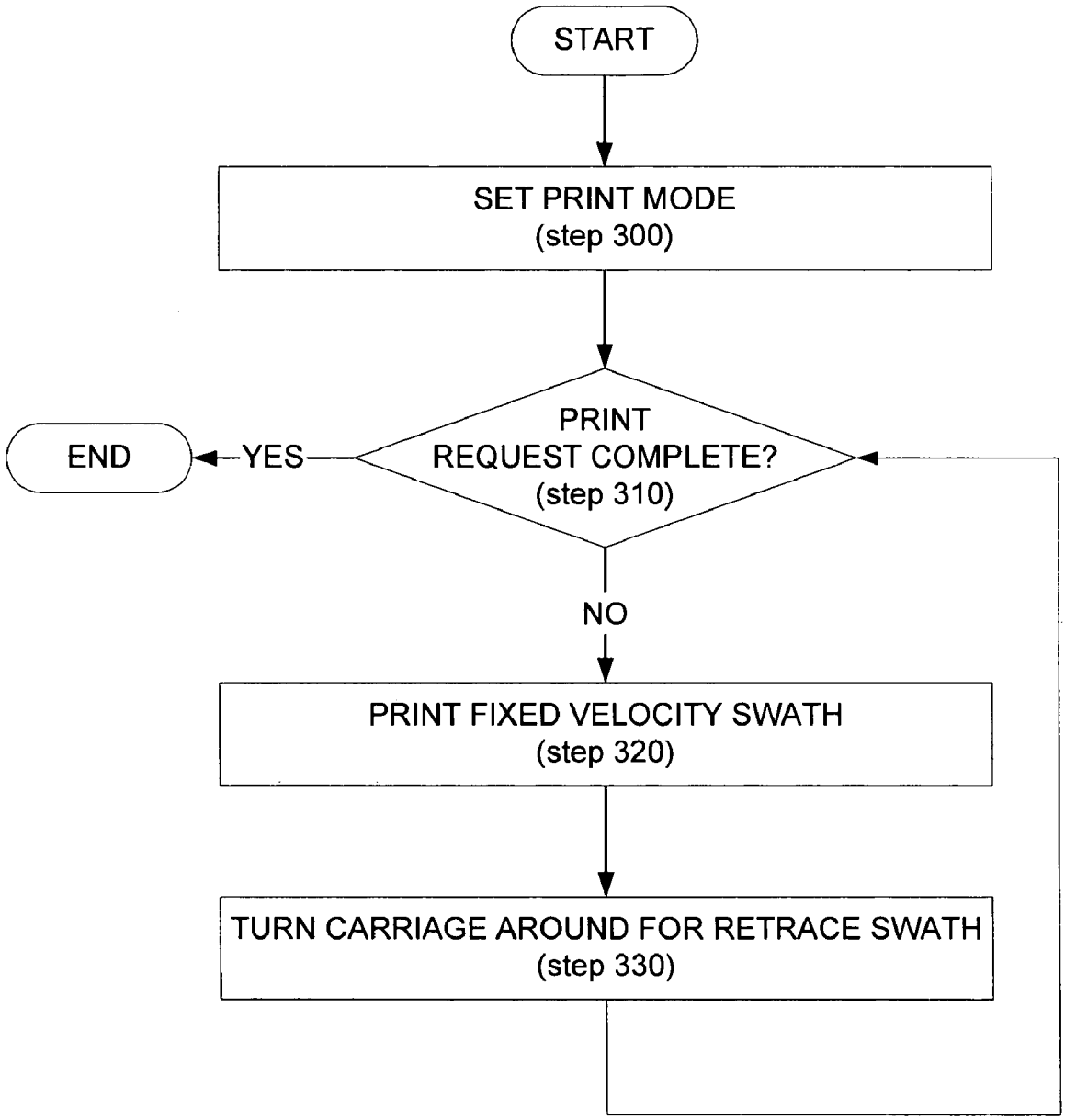
Fig. 3 Prior Art
FIG. 3 is a flow chart illustrating a traditional method for printing an image at a maximum dpi mode according to one exemplary embodiment.

FIG. 3 illustrates a method for operating an inkjet printer according to the prior art. As illustrated in FIG. 3, when a print request was traditionally received, the user would select a print operation mode (step 300). According to one exemplary embodiment, a maximum dpi mode may be selected producing an image of 4800 by 1200 optimized dpi. Once the mode was set, the computing device communicatively coupled to the inkjet printer determined whether the print request was complete (step 310). If the print request was complete (YES, step 310), then no further printing was performed. If, however, the printing request was not complete (NO, step 310), a fixed velocity swath was performed (step 320) producing an image according to the previously set dpi mode. After the fixed velocity swath was performed (step 320), the carriage was returned to its original position through a retrace swath (step 330), if operating at a maximum dpi mode, and the computing device again determined whether the print request was complete (step 310). This process was repeatedly performed until the entire print request was completed.

Figure 4:
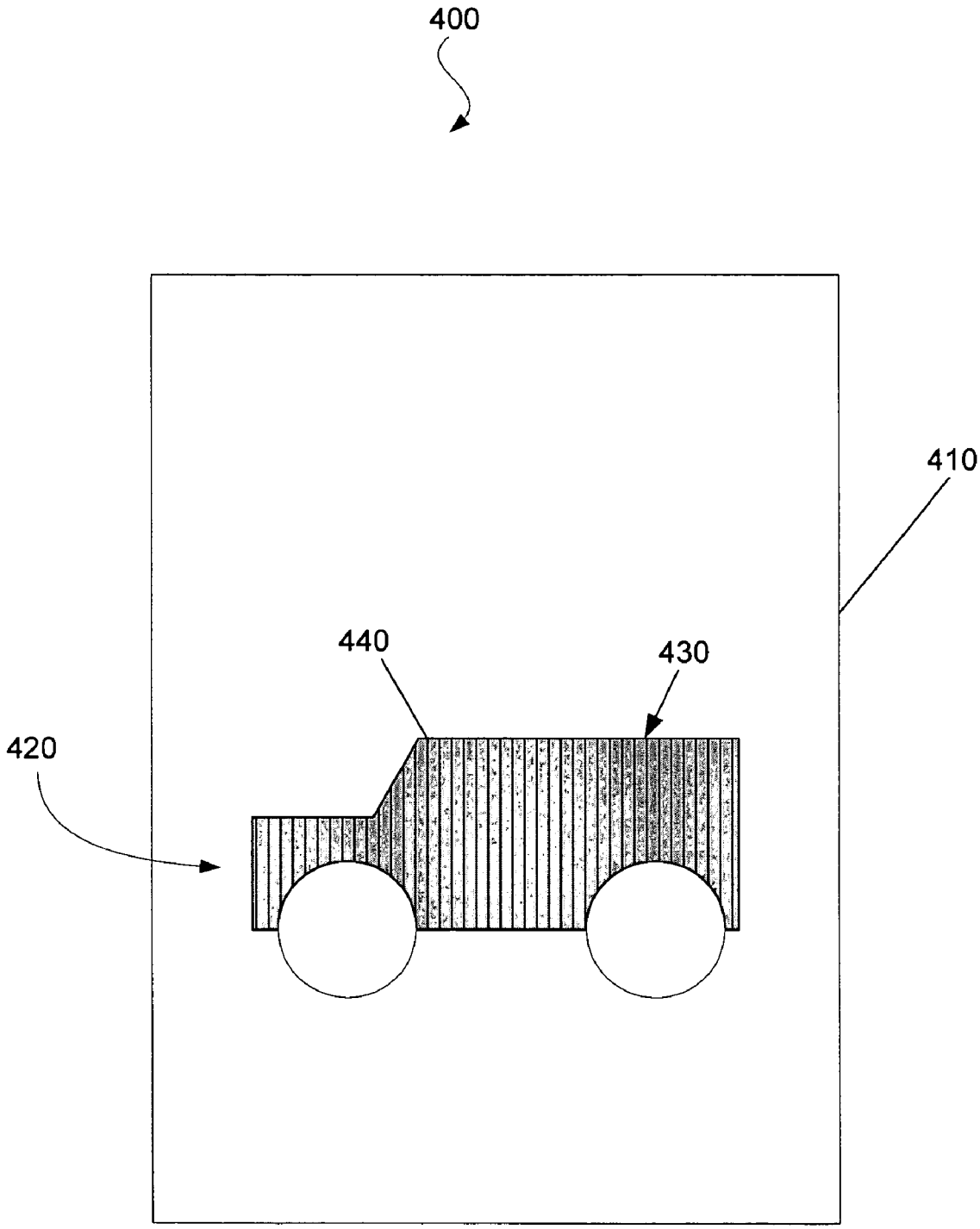
FIG. 4 is simple illustration demonstrating banding that may occur on a printed object according to one exemplary embodiment.

As described above, the traditional method illustrated in FIG. 3 may produce an effect called vertical striping caused by a repeated dynamic resonance in the printing system timed the same on each print swath due to the fixed velocity swath. FIG. 4 illustrates a print product (400) containing an image (420) printed on a print medium (410) according to the prior art methods illustrated in FIG. 3. As illustrated in FIG. 4, the image (420) contains an area of substantially uniform color and brightness (430) where printing defects may be readily observed. As illustrated in FIG. 4, a dynamic resonance is induced in the printing system due to the fixed velocity swath used in the method illustrated in FIG. 3. As a consequence of the dynamic resonance, a number of repeated darker vertical bands (430), known as vertical striping, are created and are readily noticeable in areas of substantially uniform color and brightness (430).

In order to prevent the above-described print defect, the present system and method diffuses the effect of the vibration that induces vertical banding or striping. While the print direction in the present exemplary embodiment remains unchanged, the present system and method upset the regular method of laying down printed dots by inducing variation in the print swath velocity. According to this exemplary embodiment, the following swath velocity is never the same as the one preceding it. Consequently, no two printed adjacent swaths will be laid down with the same mechanical and printed frequency. Hence this creates a true separation between the two sources of the printed defect, i.e., mechanical vibration and regular print pattern.

Figure 5:
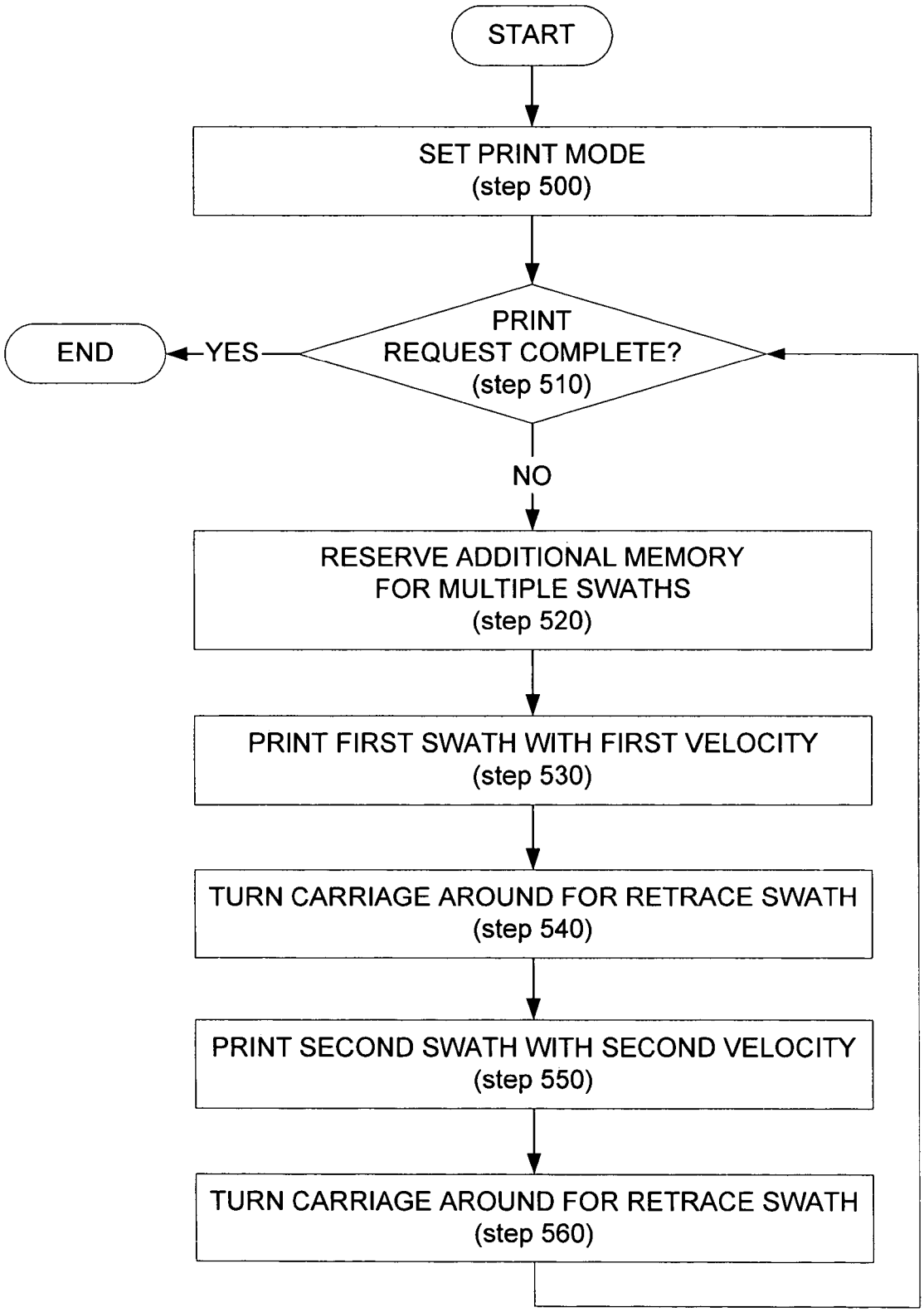
FIG. 5 is a flow chart illustrating a method for performing variable velocity printing according to one exemplary embodiment.

FIG. 5 illustrates an exemplary method that may be incorporated by an inkjet printing device to reduce the effect of vertical striping that plagues the prior art. As illustrated in FIG. 5, the present exemplary method begins by setting the inkjet printing device to a selected mode, which according to one exemplary embodiment causes the inkjet printer to print the desired image using the highest resolution available to the customer in the range of 4800 to 1200 optimized dpi (step 500). Once the printing device is set to a selected mode, the computing device determines whether the print request is complete (step 510). As illustrated in FIG. 5, if the computing device determines that the print request is complete (YES, step 510), the printing operation is complete and no further printing is performed. However, if the computing device determines that there is further printing to be performed on the present print request (NO, step 510), then the computing device reserves additional memory for multiple swaths (step 520) in preparation of further printing. After reserving additional memory, the computing device prints a first swath using a first swath velocity (step 530). Once the first swath is printed at a first velocity, the carriage is returned to its original position through a retrace swath (step 540), if operating at a maximum dpi mode. Once returned, the print carriage is then commanded to print a second swath, according to the print request, using a second swath velocity (step 550). Upon completion of the second swath, the carriage is again returned to an initial position through a retrace swath operation (step 560), if operating at a maximum dpi mode, and the computing device again determines whether the print request is complete (step 510). If the print request is still not complete (NO, step 510), the first and second variable swath velocities are again utilized to print a plurality of swaths (steps 520-550). If, however, the print request is complete (YES, step 510), no further printing is performed. The above-mentioned steps illustrated in FIG. 5 will be described in further detail below.

As illustrated in FIG. 5, the present method begins by setting the inkjet printing device to a selected mode (step 500). According to one exemplary embodiment, maximum dpi mode is the highest resolution available to the customer in the range of 4800 to 1200 optimized dpi. While the present system and method are described in the context of an inkjet printer operating in maximum dpi mode, the present system and method may be incorporated into any inkjet printer regardless of the resolution of the print job being performed. The maximum dpi mode is illustrated herein because the above-mentioned print defect is more detectable when the prior art method is utilized. However, when operating at less than maximum dpi mode, the above-mentioned retrace swaths may not be called for.

Once the printing device is set to a desired mode of operation as indicated above, the computing device determines whether the print request is complete (step 510). According to one exemplary embodiment, the computing device determines the completion of a print job by performing a rapid analysis of the data contained in a print buffer. If there is no longer data associated with the print request in the print buffer, then the computing device may conclude that the print request is complete. As illustrated in FIG. 5, if the computing device determines that the print request is complete (YES, step 510), the printing operation is complete as to that print request, and no further printing is performed.

However, if the computing device determines that there is further printing to be performed on the present print request (NO, step 510) due to additional data corresponding to the print request existing in the print buffer, then the computing device reserves additional memory for multiple swaths (step 520). According to one exemplary embodiment, the present system and method transfers data corresponding to two or more swaths from the print buffer to the inkjet print memory. According to one exemplary embodiment, the inkjet print memory includes, but is in no way limited to random access memory (RAM). If only sufficient data for a single swath exists in the print buffer, it may also be transferred to the inkjet print memory. While the present system and method are described in the context of a separate print buffer and inkjet print memory, a single data storage component may be used to perform both functions, according to one exemplary embodiment.

After reserving additional memory and transferring data corresponding to two or more swaths to the inkjet print memory, the computing device prints a first swath using a first swath velocity (step 530). As illustrated above, by printing an entire swath with a fixed swath velocity, a dynamic resonance is produced resulting in vertical striping. Accordingly, when the first swath is printed using a first velocity, a vibration amplitude, frequency, and phase corresponding to the first velocity is produced. This vibration will, in turn, produce a corresponding amount of vertical striping evident in the swath. Once the first swath is printed at a first velocity, the carriage is returned to its original position through a retrace swath (step 540) in preparation of printing a second swath stored in the inkjet print memory.

Once returned, the print carriage is then caused to print a second swath, according to the print request, using a second swath velocity (step 550). As illustrated above, the first swath that was printed using a first velocity will have corresponding vibration, producing a corresponding vertical stripe. Similarly, when printing the second swath using a second swath velocity (step 550), the second swath will have a corresponding vibration amplitude, frequency, and phase dissimilar from that of the first swath. Consequently, the amount of vertical stripe will also vary. As a result of varying the swath velocities between swaths, the resulting vertical striping will be non-contiguous thereby being masked to an observer. Additionally, the variation in swath velocities may be minimal while still producing non-contiguous striping, thereby having a minimal effect on the overall print time for the print request.

Upon completion of the second swath, the carriage is again turned around and returned to an initial position through a retrace swath (step 560) and the computing device again determines whether the print request is complete (step 510). If the print request is not complete (NO, step 510), the first and second variable swath velocities are again utilized to print a plurality of swaths (steps 520-550). If, however, the print request is complete (YES, step 510), no further printing is performed. In this manner, any vertical striping that may occur due to the constant velocity of each individual swath will be masked to a user by varying the velocity of each swath.

While the present system and method is described above in the context of alternating the use of two variable velocities for the printing of swaths, any number of variable velocities and/or patterns of alternation may be used to further mask the print defect caused by the use of a fixed print velocity.

The method illustrated in FIG. 5 may be produced in an inkjet printing device by modifying the processor readable medium (206; FIG. 2) communicatively coupled to the computing device (210; FIG. 2). According to one exemplary embodiment, the processor readable medium may be modified so as to have instructions thereon for alternating the swath velocities of adjacent swaths. This modification of the swath velocities may be performed by the computing device at any number of processing steps. According to one exemplary embodiment, the processor readable medium (206; FIG. 2) includes instructions thereon for varying the swath velocities of adjacent swaths during the original rasterization of print data into independent print swaths, or alternatively, after being sent to the inkjet print memory (204; FIG. 2) prior to printing.

Moreover, since the present system and method may be incorporated by modifying a processor readable medium associated with an inkjet printing device is in no way limited to newly produced inkjet printing devices. Rather, since the present system and method include a software solution, according to one alternative embodiment, the present method can be applied to any existing printer in the market, via a software upgrade.

Figure 6:
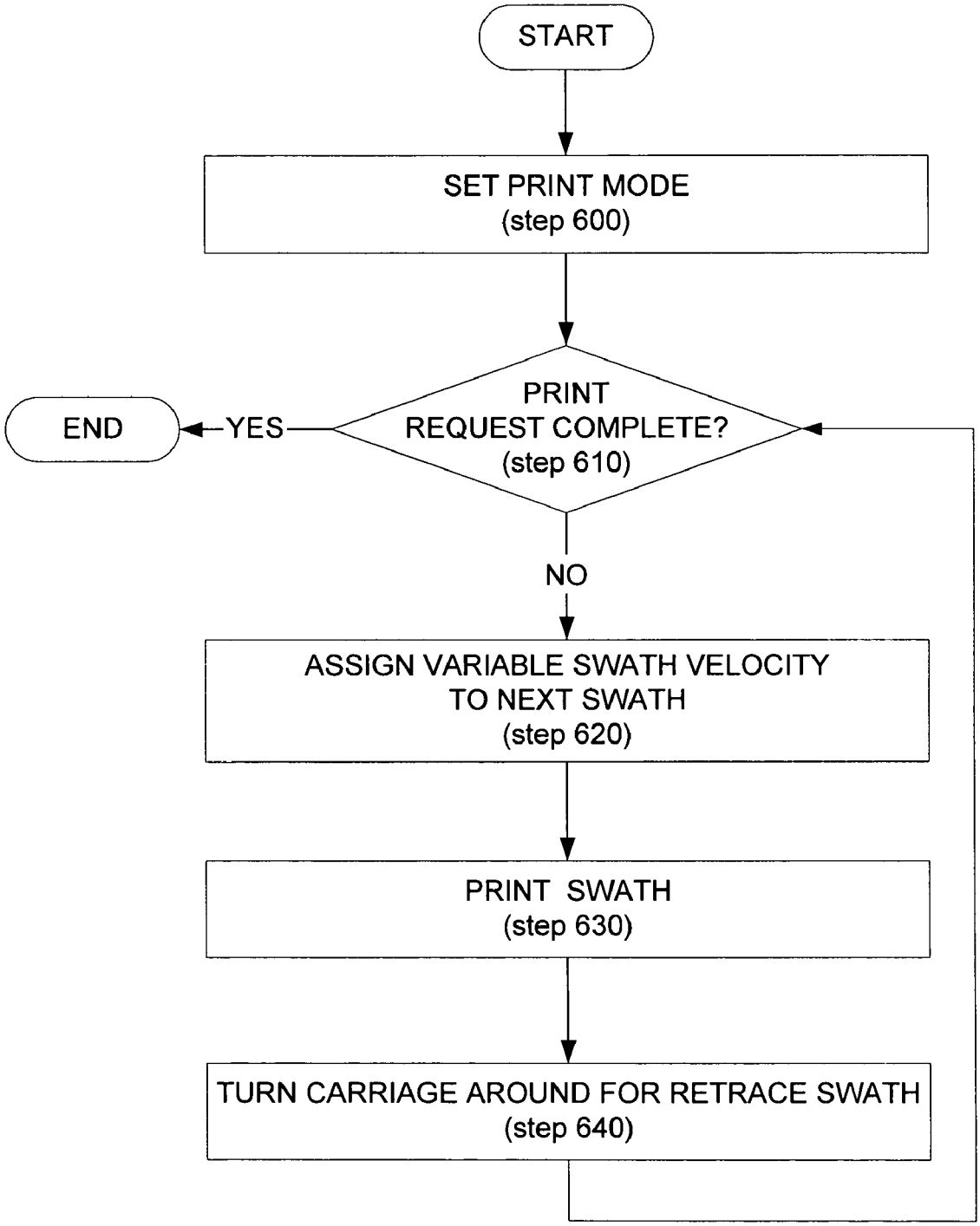
FIG. 6 is a flow chart illustrating a method for performing a variable velocity printing operation according to one exemplary embodiment.

FIG. 6 illustrates an alternative embodiment of the present system and method for reducing the effect of cyclic defects in a printed image. As illustrated in FIG. 6, the present alternative embodiment begins by setting the printer to a desired print mode (step 600). According to one exemplary embodiment, a maximum dpi mode may be selected. Once the mode is set, the computing device communicatively coupled to the inkjet printer determines whether the print request is complete (step 610) according to the methods illustrated above. If the print request was complete (YES, step 610), then no further printing was performed.

If, however, the print request is not yet complete (NO, step 610), then the next swath is received by the inkjet printer and a variable swath velocity is assigned thereto (step 620). According to one exemplary embodiment, the swath velocity may be selected from a list of varying swath velocities. The selection of the swath velocity for each consecutive swath may be either random or the selection may deliberately vary back and forth between any number of variable swath lengths. Once the swath velocity is assigned, the swath may be printed (step 630). After the designated swath is printed, the carriage may be returned to an original position through a retrace swath (step 640), if operating at a maximum dpi mode, and the coupled computing device will again determine if the print request is complete (step 610). If the print request is not yet complete (NO, step 610), the above-mentioned process will again be performed using a different swath length.

The exemplary embodiment illustrated in FIG. 6 simplifies the exemplary method illustrated in FIG. 5 by reducing the step of allocating additional memory for printing. Rather, the variation of swath velocity used for abutting swaths is assigned on a swath by swath basis.

In conclusion, the present system and method effectively eliminates defects that result from printing an image with an inkjet printer functioning at a constant swath velocity. More specifically, the present system and method overcomes the cyclic defects by upsetting the regularity of the printing order, which is the primary cause of uniform repeated striping on the printed image. By preventing any two printed adjacent swaths from being laid down with the same mechanical and printed (spatial) frequency, the present system and method effectively masks the traditional vertical striping effect.

The preceding description has been presented only to illustrate and describe exemplary embodiments of the present system and method. It is not intended to be exhaustive or to limit the present system and method to any precise form disclosed. Many modifications and variations are possible in light of the above teaching. It is intended that the scope of the present system and method be defined by the following claims.

What is claimed is:

1. A method for variable velocity printing comprising:

printing a first swath at a first swath velocity in a first direction; and printing a second swath in said first direction at a second swath velocity, wherein said first and second swath velocities are different, such that no two adjacent swaths printed in said first direction are printed at a same swath velocity, wherein a difference between said first swath velocity and said second swath velocity is minimized while still making vertical striping non-contiguous and minimizing an effect on overall print time.

2. The method of claim 1, wherein said first and said second velocities exhibit different mechanical frequencies, amplitudes, or phases when used in a printer.

3. The method of claim 1, further comprising performing a retrace swath between said first and said second swath.

4. The method of claim 1, wherein said printing is performed according to a maximum dot per inch mode.

5. The method of claim 1, wherein said method is performed with an inkjet printer.

6. A means for variable velocity printing comprising:

a means for processing data; and a means for printing an image communicatively coupled to said data processing means;

wherein said data processing means includes a processor readable medium having instructions thereon for causing said printing means to print adjacent swaths of a print job at different printing velocities, such that no two adjacent swaths printed in a same first direction are printed at a same swath velocity; and wherein a difference between a first swath velocity and a second swath velocity is minimized while still making vertical striping non-contiguous and minimized an effect on overall print time.

7. The variable velocity printing means of claim 6, wherein said processor readable medium further comprises instructions for:

assigning a first print velocity to a first print swath;

assigning a second print velocity to a second print swath; and assigning a third print velocity to a third print swath;

wherein said first and third print velocities are not equal to said second print velocity.

8. The variable velocity printing means of claim 7, wherein said first, second, and third print velocities comprise constant print velocities.

9. The variable velocity printing means of claim 7, wherein said assignments are performed while data corresponding to said print swaths is present in a means for storing data of said printing means.

10. The variable velocity printing means of claim 7, wherein said first, second, and third print velocities are selected from a list of more than two varying print velocities.

11. The variable velocity printing means of claim 10, wherein said first, second, and third print velocities are randomly selected from said list of varying print velocities.

12. The variable velocity printing means of claim 7, wherein said first and third print velocities produce a different mechanical frequency, amplitude, or phase in said printing means than said second print velocity.

13. The variable velocity printing means of claim 6, wherein said printing means comprises:

an inkjet printer including a printhead;

wherein said printhead comprises one of a thermally activated inkjet material dispenser, a mechanically activated inkjet material dispenser, an electrically activated inkjet material dispenser, a magnetically activated material dispenser, or a piezoelectrically activated material dispenser.

* * * * *

UNITED STATES PATENT AND TRADEMARK OFFICE

CERTIFICATE OF CORRECTION

PATENT NO. : 7,364,262 B2
APPLICATION NO. : 10/899989
DATED : April 29, 2008
INVENTOR(S) : Jason M. Quintana It is certified that error appears in the above-identified patent and that said Letters Patent is hereby corrected as shown below:

In column 8, line 47, in Claim 6, delete "minimized" and insert -- minimizing --, therefor.

Signed and Sealed this

Twelfth Day of August, 2008

JON W. DUDAS
*Director of the United States Patent and Trademark Office*